US009708753B2

(12) United States Patent
Yoo et al.

(10) Patent No.: US 9,708,753 B2
(45) Date of Patent: Jul. 18, 2017

(54) LAUNDRY TREATING APPARATUS

(71) Applicant: LG ELECTRONICS INC., Seoul (KR)

(72) Inventors: Taewoo Yoo, Seoul (KR); Hoil Jeon, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 14/779,741

(22) PCT Filed: Apr. 2, 2014

(86) PCT No.: PCT/KR2014/002815

§ 371 (c)(1),
(2) Date: Sep. 24, 2015

(87) PCT Pub. No.: WO2014/163388

PCT Pub. Date: Oct. 9, 2014

(65) Prior Publication Data

US 2016/0047083 A1 Feb. 18, 2016

(30) Foreign Application Priority Data

Apr. 2, 2013 (KR) ..... 10-2013-0035589
Apr. 2, 2013 (KR) ..... 10-2013-0035590

(51) Int. Cl.
*D06F 81/00* (2006.01)
*D06F 81/02* (2006.01)
(Continued)

(52) U.S. Cl.
CPC ..... *D06F 81/00* (2013.01); *D06F 29/00* (2013.01); *D06F 71/32* (2013.01); *D06F 75/00* (2013.01);
(Continued)

(58) Field of Classification Search
CPC ... A47B 35/00; A47B 2003/008; D06F 81/00; D06F 81/02; D06F 81/003; D06F 81/08;
(Continued)

(56) References Cited

U.S. PATENT DOCUMENTS 190,409 A 5/1877 Bovey
870,805 A * 11/1907 Trager ..... A47B 81/00 108/28
(Continued)

FOREIGN PATENT DOCUMENTS

CH 311166 11/1955
CN 1148420 4/1997
(Continued)

OTHER PUBLICATIONS

International Search Report dated Aug. 14, 2014 issued in Application No. PCT/KR2014/002815.
(Continued)

*Primary Examiner* — Ismael Izaguirre
(74) *Attorney, Agent, or Firm* — KED & Associates, LLP

(57) ABSTRACT

A laundry treating apparatus (100) is disclosed. The laundry treating apparatus (100) includes a cabinet (1) forming an external appearance of the laundry treating apparatus, a support part (2) configured to be withdrawable from the cabinet (1), the support part (2) providing a space to support laundry when the laundry is withdrawn from the cabinet (1), and a laundry treating unit (5) configured to be withdrawable from the cabinet (1), the laundry treating unit (5) supplying at least one of heat and moisture to the laundry supported by the support part (2).

22 Claims, 10 Drawing Sheets

(51) Int. Cl.

| | |
|---|---|
| ***D06F 81/06*** | (2006.01) |
| ***D06F 81/08*** | (2006.01) |
| ***D06F 75/00*** | (2006.01) |
| ***D06F 75/16*** | (2006.01) |
| ***D06F 71/32*** | (2006.01) |
| ***D06F 87/00*** | (2006.01) |
| ***D06F 29/00*** | (2006.01) |

(52) U.S. Cl.
CPC ..... *D06F 75/16* (2013.01); *D06F 81/003* (2013.01); *D06F 81/02* (2013.01); *D06F 81/06* (2013.01); *D06F 81/08* (2013.01); *D06F 87/00* (2013.01)

(58) Field of Classification Search
CPC ..... D06F 75/40; D06F 81/06; D06F 75/00; D06F 75/16; D06F 71/32; D06F 87/00; D06F 28/00
USPC ..... D32/66, 73
See application file for complete search history.

(56) References Cited

U.S. PATENT DOCUMENTS

| | | | | |
|---|---|---|---|---|
| 2,447,480 | A * | 8/1948 | Stubbs | A47B 35/00 108/13 |
| 3,699,673 | A | 10/1972 | Foster et al. | |
| 3,732,639 | A | 5/1973 | Elder | |
| 5,609,047 | A | 3/1997 | Hellman, Jr. et al. | |
| 7,210,254 | B2 * | 5/2007 | Docker | D06F 81/08 38/104 |
| 7,555,856 | B2 * | 7/2009 | Sunshine | A47B 46/00 38/104 |
| 8,151,496 | B2 * | 4/2012 | Lee | D06F 75/12 38/75 |
| 8,424,227 | B2 * | 4/2013 | Harrington | D06F 75/18 38/77.8 |
| 2007/0151300 | A1 | 7/2007 | Sunshine | |
| 2009/0313863 | A1 | 12/2009 | Achterberg et al. | |
| 2010/0242317 | A1 * | 9/2010 | Trowsdale | D06F 81/08 38/103 |
| 2011/0265524 | A1 | 11/2011 | Kim et al. | |

FOREIGN PATENT DOCUMENTS

| | | |
|---|---|---|
| CN | 1352712 | 6/2002 |
| CN | 2630295 | 8/2004 |
| CN | 1791716 | 6/2006 |
| CN | 101213338 | 7/2008 |
| DE | 20 64 793 | 7/1972 |
| EP | 1 895 039 | 3/2008 |
| EP | 1 925 703 | 5/2008 |
| EP | 2 196 573 | 6/2010 |
| NL | 7116640 | 6/1972 |
| WO | WO 02/072941 A1 | 9/2002 |
| WO | WO 2006/112611 | 10/2006 |
| WO | WO 2007/004135 A1 | 1/2007 |

OTHER PUBLICATIONS

Chinese Office Action dated Jun. 1, 2016 issued in Application No. 201480020180.8 (English translation attached).
European Search Report dated Oct. 6, 2016 issued in Application No. 14779343.4.

* cited by examiner (a)

(b)

LAUNDRY TREATING APPARATUS

CROSS-REFERENCE TO RELATED PATENT APPLICATIONS

This application is a U.S. National Stage Application under 35 U.S.C. §371 of PCT Application No. PCT/KR2014/002815, filed Apr. 2, 2014, which claims priority to Korean Patent Application Nos. 10-2013-0035589 and 10-2013-0035590, both filed Apr. 2, 2013, whose entire disclosures are hereby incorporated by reference.

TECHNICAL FIELD

The present invention relates to a laundry treating apparatus.

BACKGROUND ART

The concept of a laundry treating apparatus includes a washing machine that removes contaminants from laundry using wash water and a detergent, a drying device that dries washed laundry, and a device (refresher) that removes odor or wrinkles from the laundry.

Among conventional laundry treating apparatuses configured to remove wrinkles or odor from the laundry, a device configured to supply steam into the space accommodating laundry and an iron configured to supply heat and steam to the laundry are generally used.

In the case that a refresh such as an iron is used, an ironing board to support the laundry is provided separately from the iron, and therefore a user needs to inconveniently prepare both an iron and an ironing board every time ironing is needed.

In addition, a separate space for storing the ironing board and the iron after ironing is needed. Accordingly, storing the ironing board and the iron has also caused inconvenience.

Moreover, conventional irons have been commonly configured to supply heat and steam together to the laundry or to supply only heat to the laundry, rather than supplying one of heat and steam to the laundry.

That is, conventional irons capable of supplying steam and heat to the laundry have had a structure that does not allow steam to be supplied to the laundry without heat, and therefore they have disadvantageously caused users to purchase a separate device configured to supply only steam to the laundry.

DISCLOSURE OF INVENTION

Technical Problem

An object of the present invention devised to solve the problem lies in a laundry treating apparatus having a laundry treating unit (an iron) configured to supply at least one of heat and moisture to laundry and a support part configured to support the laundry.

Another object of the present invention devised to solve the problem lies in a laundry treating apparatus having a laundry treating unit capable of supplying one or both of heat and moisture to the laundry.

Solution to Problem

The object of the present invention can be achieved by providing a laundry treating apparatus including a cabinet forming an external appearance of the laundry treating apparatus, a support part configured to be withdrawable from the cabinet, the support part providing a space to support laundry when the laundry is withdrawn from the cabinet, and a laundry treating unit configured to be withdrawable from the cabinet, the laundry treating unit supplying at least one of heat and moisture to the laundry supported by the support part.

The support part may include a first support plate and a second support plate, the first and second support plates forming the space to support the laundry when withdrawn from the cabinet and unfolded.

The support part may further include a laundry fixing unit provided to at least one of the first support plate and the second support plate to fix the laundry to surfaces of the first support plate and the second support plate.

Each of the first support plate and the second support plate may include a support plate base providing a space to accommodate the laundry fixing unit, a cover provided to an upper portion of the support plate base to support the laundry, the cover allowing external air to be supplied into the support plate base therethrough, and an exhaust hole allowing an interior of the support plate base to communicate with an exterior of the support plate base, wherein the laundry fixing unit may be a fan to discharge air from the interior of the support plate base to the exterior of the support plate base through the exhaust hole.

The laundry treating apparatus may further include a hinge unit to rotatably couple the first support plate with the second support plate, and a withdrawing unit provided in the cabinet to guide the hinge unit such that the hinge unit is withdrawn from or introduced into the cabinet.

The withdrawing unit may include a base supporter to support the hinge unit, and a first guider and a second guider provided in the cabinet in a height direction of the cabinet, the first and second guiders guiding movement of the base supporter in the height direction of the cabinet.

The hinge unit may include a hinge housing fixed to the base supporter, a first guider hole and a second guider hole provided to opposing ends of the hinge housing facing each other, a first hinge configured to be withdrawable from the first guider hole, the first hinge being fixed to the first support plate, and a second hinge configured to be withdrawable from the second guider hole, the second hinge being fixed to the second support plate.

The hinge housing may be rotatably coupled to the base supporter.

The first hinge may include a first fixed flange fixed to the first support plate and a first insertion flange extending from the first fixed flange and forming a curved surface, and the second hinge may include a second fixed flange fixed to the second support plate and a second insertion flange extending from the second fixed flange and forming a curved surface, wherein each of the first guider hole and the second guider hole may include a curved surface to accommodate a corresponding one of the insertion flanges such that the curve surface penetrates opposing ends of the hinge housing facing each other.

The first guider hole and the second guider hole may be stacked in the height direction of the cabinet, wherein a width of the second fixed flange may be greater than a width of the first fixed flange, and the second insertion flange may be provided to opposing ends of the second fixed flange facing each other such that the second insertion flanges are spaced apart from each other to accommodate the first insertion flange therebetween.

The laundry treating unit may include a moisture supply unit including a body having a handle and a discharge hole provided to the body to discharge moisture to the laundry, a heat supply unit detachably provided to the body to supply heat to the laundry.

The cabinet may include a first accommodation portion to accommodate the support part, a second accommodation portion to accommodate the laundry treating unit, and a first partition wall arranged in the height direction of the cabinet to partition the first accommodation portion and the second accommodation portion.

The second accommodation portion may include an inclined surface configured to support the laundry treating unit and be inclined upward in a direction of withdrawal of the laundry treating unit.

The laundry treating apparatus may further include a moisture generation unit to generate moisture and supply the same to the moisture supply unit, wherein the cabinet may further include a third accommodation portion positioned under the second accommodation portion to accommodate the moisture generation unit.

The moisture generation unit may include a steam generation unit to supply steam generated by heating water to the moisture supply unit, a water supply unit configured to be withdrawable from the third accommodation portion, the water supply unit supplying water to the steam generation unit by being connected to the steam generation unit when inserted into the third accommodation portion.

The cabinet may further include a third accommodation portion door to open and close the third accommodation portion, wherein the third accommodation portion door may include a door body to open and close the third accommodation portion, the door body being rotatably coupled to the cabinet, a supply unit support plate extending from the door body to support a lower surface of the water supply unit.

The water supply unit may include a supply tank supported on the supply unit support plate and a check valve provided on a bottom surface of the supply tank, and the steam generation unit may include a storage tank to store water, a connection conduit provided to the storage tank to open the check valve and allow water to be introduced into the storage tank when the supply tank is inserted into the third accommodation portion, a heater provided in the storage tank, and a supply tube to supply steam from the storage tank to the laundry treating unit.

The heat supply unit may include a heating plate detachably provided to the moisture supply unit, and a heating plate through hole penetrating the heating plate and connected to the discharge hole.

The heating plate may further include a heating plate body formed of a conductor and provided with the heating plate through hole, a heating plate heater to heat the heating plate body, and an insulation part fixed to the heating plate body and detachably coupled to the body, the insulation part blocking transfer of heat of the heating plate body to the body.

The laundry treating apparatus may further include a sealing groove provided to one of an outer circumferential surface of the discharge hole and an outer circumferential surface of the heating plate through hole, and a sealing conduit provided to the other one of the outer circumferential surface of the discharge hole and the outer circumferential surface of the heating plate through hole to be inserted into the sealing groove.

The laundry treating apparatus may further include a mounting part to detachably couple the heat supply unit to the moisture supply unit, wherein the mounting part may include a mounting groove provided to one of the body and the heating plate, and a mounting protrusion provided to the other one of the body and the heating plate to be mounted to and detached from the mounting groove.

The laundry treating unit may further include a power supply to supply power to the heating plate heater, wherein the power supply may include a first terminal provided to the body, the first terminal being connected to a power source, and a second terminal provided to the insulation part to contact the first terminal, the second terminal being configured to supply power from the first terminal to the heating plate heater.

The laundry treating apparatus may further include a moisture generation unit to generate moisture and supply the same to the discharge hole, the moisture generation unit being provided in the body, wherein the moisture generation unit includes a storage tank provided in the body to store water, a heater provided in the storage tank to heat the water, and a supply tube connecting the storage tank to the discharge hole.

Advantageous Effects of Invention

A laundry treating apparatus according to an embodiment of the present invention has a laundry treating unit capable of supplying at least one of heat and moisture to the laundry and a support part configured to support the laundry.

In addition, a laundry treating apparatus according to an embodiment of the present invention has a laundry treating unit capable of supplying one or both of heat and moisture to the laundry.

BRIEF DESCRIPTION OF DRAWINGS

The accompanying drawings, which are included to provide a further understanding of the invention, illustrate embodiments of the invention and together with the description serve to explain the principle of the invention.

In the drawings.

BEST MODE FOR CARRYING OUT THE INVENTION

Reference will now be made in detail to the preferred embodiments of the present invention, examples of which are illustrated in the accompanying drawings. Configuration of an apparatus or a control method described below is simply provided to illustrate embodiments of the present invention and is not intended to limit the scope of the present invention.

Figure 1:
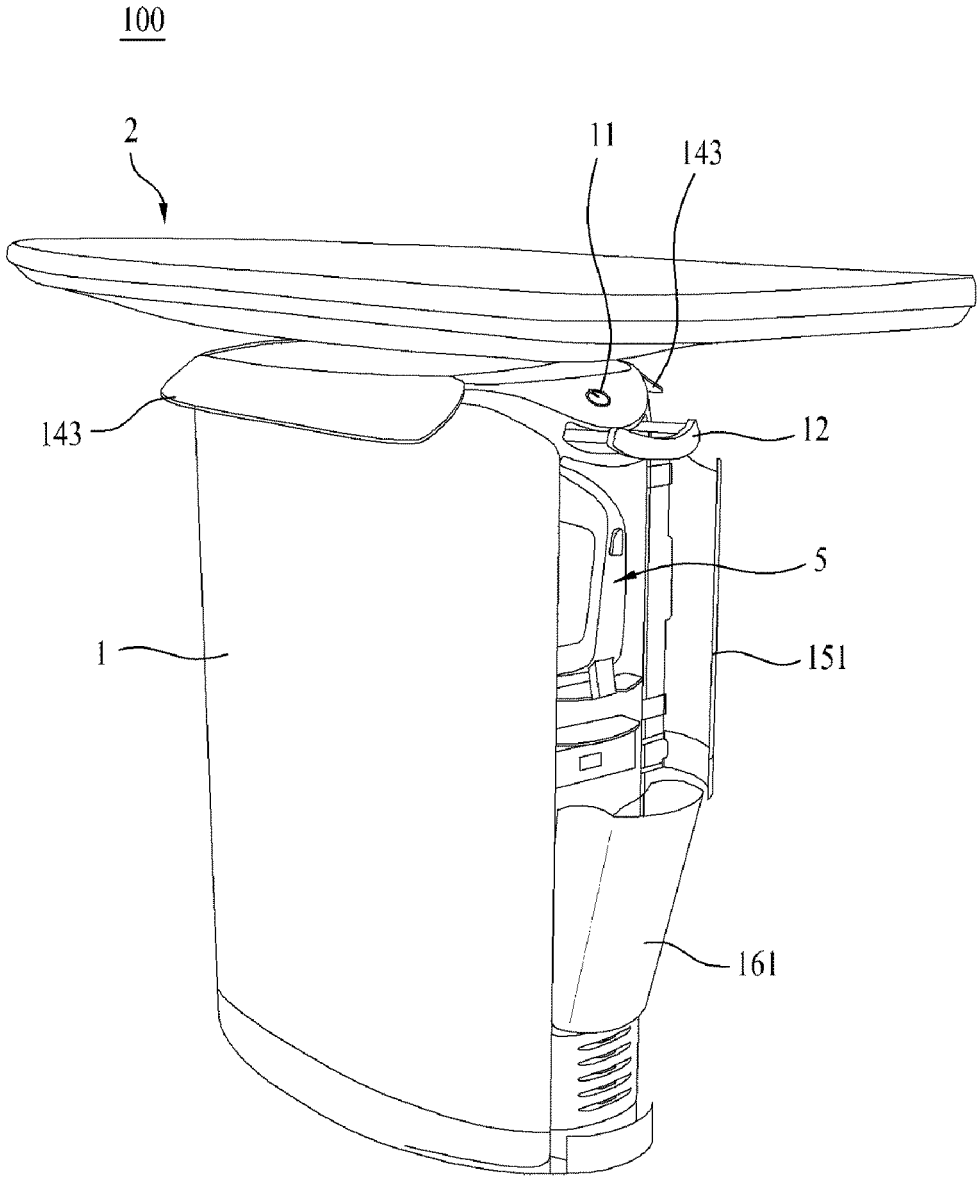
FIG. 1 is a view showing the external appearance of a laundry treating apparatus according to an exemplary embodiment of the present invention.

As shown in FIG. 1, a laundry treating apparatus 100 includes a cabinet 1 forming an external appearance of the laundry treating apparatus 100 and having an accommodation space therein, a support part 2 arranged to be withdrawable from the cabinet 1 to form a space for supporting laundry when withdrawn from the cabinet 1, and a laundry treating unit 5 arranged to be withdrawable from the cabinet 1 to supply at least one of moisture (mist, steam, and the like) and heat to the laundry.

The cabinet 1 is provided with a power switch 11 configured to control supply of power to a steam generation unit 6, a laundry fixing unit 27 and a heat supply unit 53, which will be described later. Unlike FIG. 1, a plurality of power switch 11 may be provided on the front surface of the cabinet 1.

In the case that a plurality of power switch 11 is provided, one power switch may control operation of the steam generation unit 6, another power switch may control operation of the laundry fixing unit 27, which will be described later, and a further power switch may control the heat supply unit 53 provided to the laundry treating unit 5.

Figure 2:
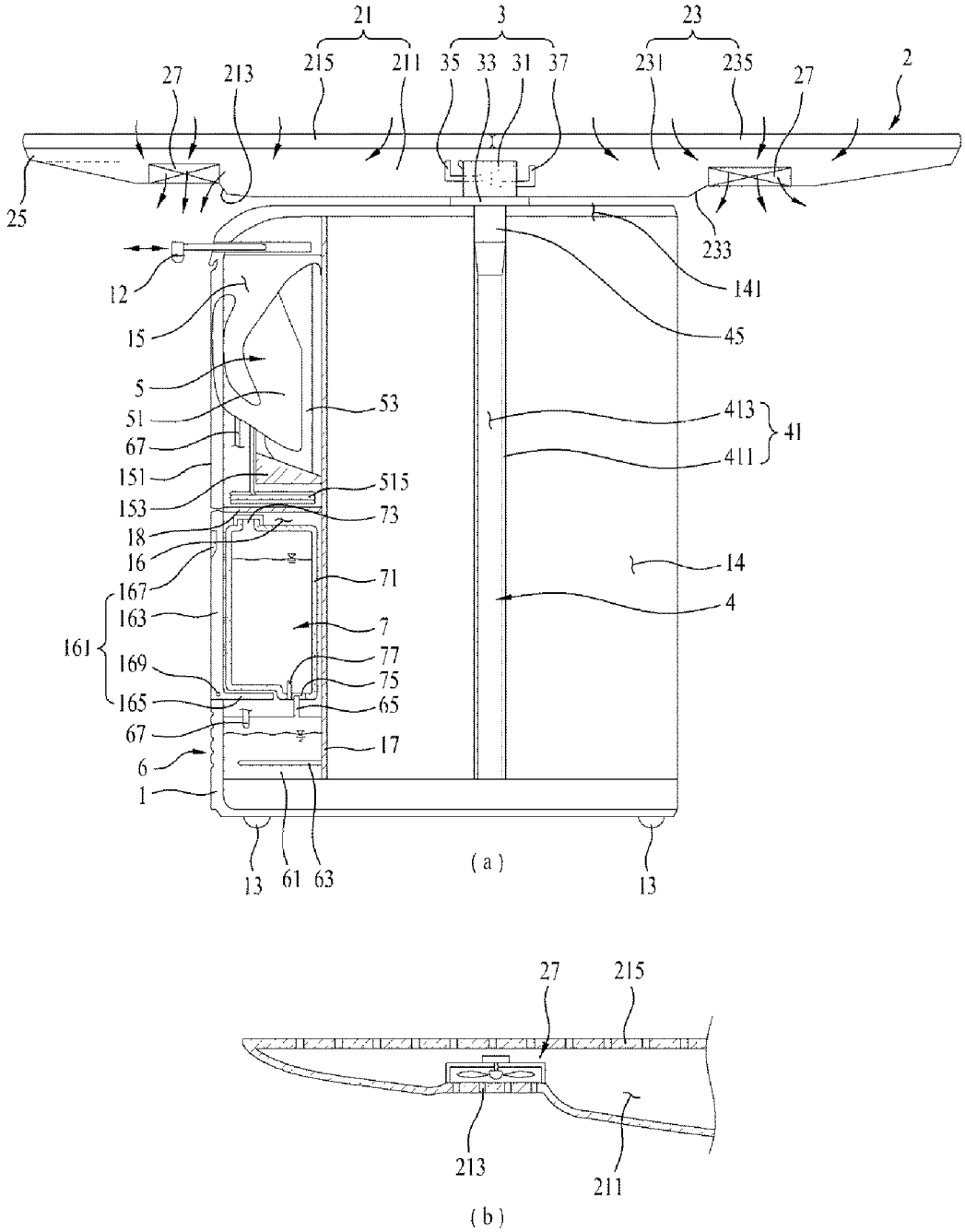
FIG. 2 is a view illustrating the structure of a laundry treating apparatus according to one embodiment of the present invention.

As shown in FIG. 2, the cabinet 1 may be further provided with a cabinet handle 12 and a roller 13 which allow the laundry treating apparatus 100 to move.

The cabinet handle 12 may be withdrawable from the front surface of the cabinet 1, and the roller 13 may be rotatably provided on the bottom surface of the cabinet 1. Accordingly, the cabinet handle 12 and the roller 13 may allow the user to easily move the laundry treating apparatus 100.

A first accommodation portion 14 to accommodate the support part 2, a second accommodation portion 15 to accommodate the laundry treating unit 5, and a third accommodation portion 16 to accommodate moisture generation units 6 and 7 configured to generate moisture and supply the same to the laundry treating unit 5 may be provided in the cabinet 1.

The second accommodation portion 15 and the third accommodation portion 16 are caused to form a space distinguishable from the first accommodation portion 14 by a first partition wall 17 arranged in the height direction of the cabinet 1. In addition, the second accommodation portion 15 and the third accommodation portion 16 are caused to form spaces distinguished from each other, by a second partition wall 18 arranged in the longitudinal direction of the cabinet 1 and fixed to the first partition wall 17.

The first accommodation portion 14 includes a open surface 141 positioned at the upper surface of the cabinet 1 and a first accommodation portion door 143 (see FIG. 1) to open and close the open surface 141. Accordingly, the user may open the first accommodation portion door 143 to withdraw or insert the support part 2 from or into the first accommodation portion 14.

The second accommodation portion 15 may include a second accommodation portion door 151 rotatably provided on the front surface of the cabinet 1 to open and close the second accommodation portion 15. In addition, an inclined surface 153 supporting the lower surface of the laundry treating unit 5 is provided in the second accommodation portion 15.

The inclined surface 153 may be inclined upward in the direction in which the laundry treating unit 5 is withdrawn from the second accommodation portion 15. This allows the user to easily withdraw or insert the laundry treating unit 5 from or into the second accommodation portion 15.

The third accommodation portion 16 may be positioned under the second accommodation portion 15. The third accommodation portion 16 may include a third accommodation portion door 161 rotatably fixed to the front surface of the cabinet 1.

The third accommodation portion door 161 includes a door body 163 arranged in parallel with the bottom surface of the cabinet 1 and rotated by a door rotating shaft 169, and a tank support plate 165 extending from the door body 163 into the third accommodation portion 16 to support a water supply unit 7 provided to the moisture generation unit. The door body 163 may be provided with a door handle 167.

The support part 2 includes a first support plate 21 and a second support plate 23, which provide a space where the laundry is supported by being unfolded when they are withdrawn from the first accommodation portion 14.

The first support plate 21 and the second support plate 23 are rotatably coupled to each other by a hinge unit 3, which will be described later. The hinge unit 3 is withdrawn from or inserted into the first accommodation portion 14 by a withdrawing unit 4.

Accordingly, the first support plate 21 and the second support plate 23 are withdrawn from the first accommodation portion 14 and then rotated in different directions by the hinge unit 3 and the withdrawing unit 4 to form a space where the laundry is supported. Structures of the hinge unit 3 and the withdrawing unit 4 will be described later.

The support part 2 may further include a laundry fixing unit 27 provided to at least one of the first support plate 21 and the second support plate 23 to fix laundry positioned on the support plates 21 and 23 to the surfaces of the support plates 21 and 23.

FIG. 2 illustrates a case in which the laundry fixing unit 27 is provided to each of the first support plate 21 and the second support plate 23.

The first support plate 21 includes a first base 211 providing a space to arrange the laundry fixing unit 27 in, a first exhaust hole 213 penetrating the first base 211, and a first cover 215 positioned at the upper portion of the first base 211 to support the laundry.

The first cover 215 provides a space where the laundry is supported and allows air to be introduced into the first base 211 therethrough.

That is, the first cover 215 may be formed of a material such as fabric that allows flow of air therethrough and fixed to the upper portion of the first base 211. The first cover 215 may include a plate fixed to the upper portion of the first base 211 and a hole penetrating the plate to allow the interior of the first base 211 to communicate with the exterior of the first base 211.

The second support plate 23 may have the same structure as that of the first support plate 21. Accordingly, the second support plate 23 may also include a second base 231 providing a space in which to arrange the laundry fixing unit 27, a second cover 235 positioned at the upper portion of the second base 231 to support the laundry, and a second exhaust hole 233 penetrating the second base 231.

The laundry fixing unit 27 may include fans provided to the first exhaust hole 213 and the second exhaust hole 233 respectively to discharge air from the bases 211 and 231.

When the air is discharged from the bases 211 and 231 through the exhaust holes 213 and 233, the air outside the bases 211 and 231 is introduced into the bases 211 and 231 through the covers 215 and 235. Thereby, the laundry placed on the covers 215 and 235 may be fixed to the surfaces of the support plates.

Figure 3:
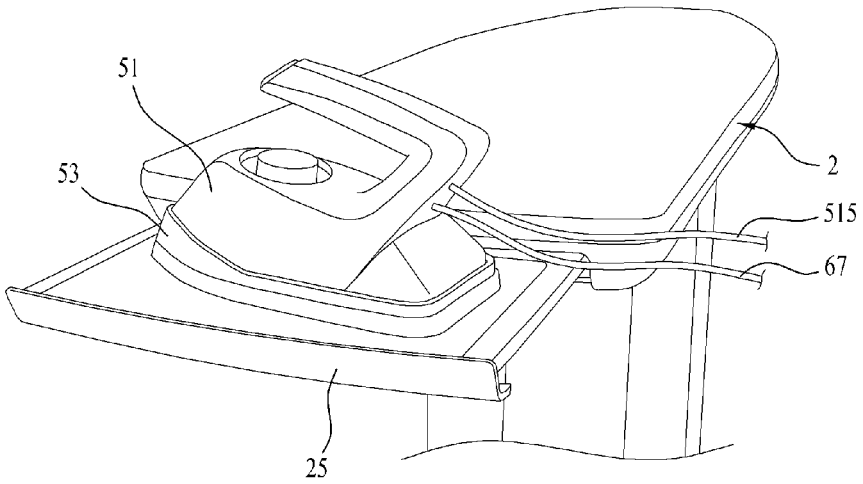
FIG. 3 is a view illustrating a shelf according to one embodiment of the present invention.

The support part 2 may further include a shelf 25 on which the laundry treating unit 5 is placed. The shelf 25 may be provided to at least one of the first support plate 21 and the second support plate 23. FIGS. 2 and 3 illustrate an example of a structure of the shelf 25 that is withdrawable from the first support plate 21.

The hinge unit 3 connects the first support plate 21 to the second support plate 23 such that the first support plate 21 and the second support plate 23 are unfolded and folded. The withdrawing unit 4 allows the hinge unit 3 to reciprocate in the first accommodation portion 14 in the direction of height of the cabinet 1 such that the support part 2 is withdrawn from and inserted into the first accommodation portion 14.

Figure 4:
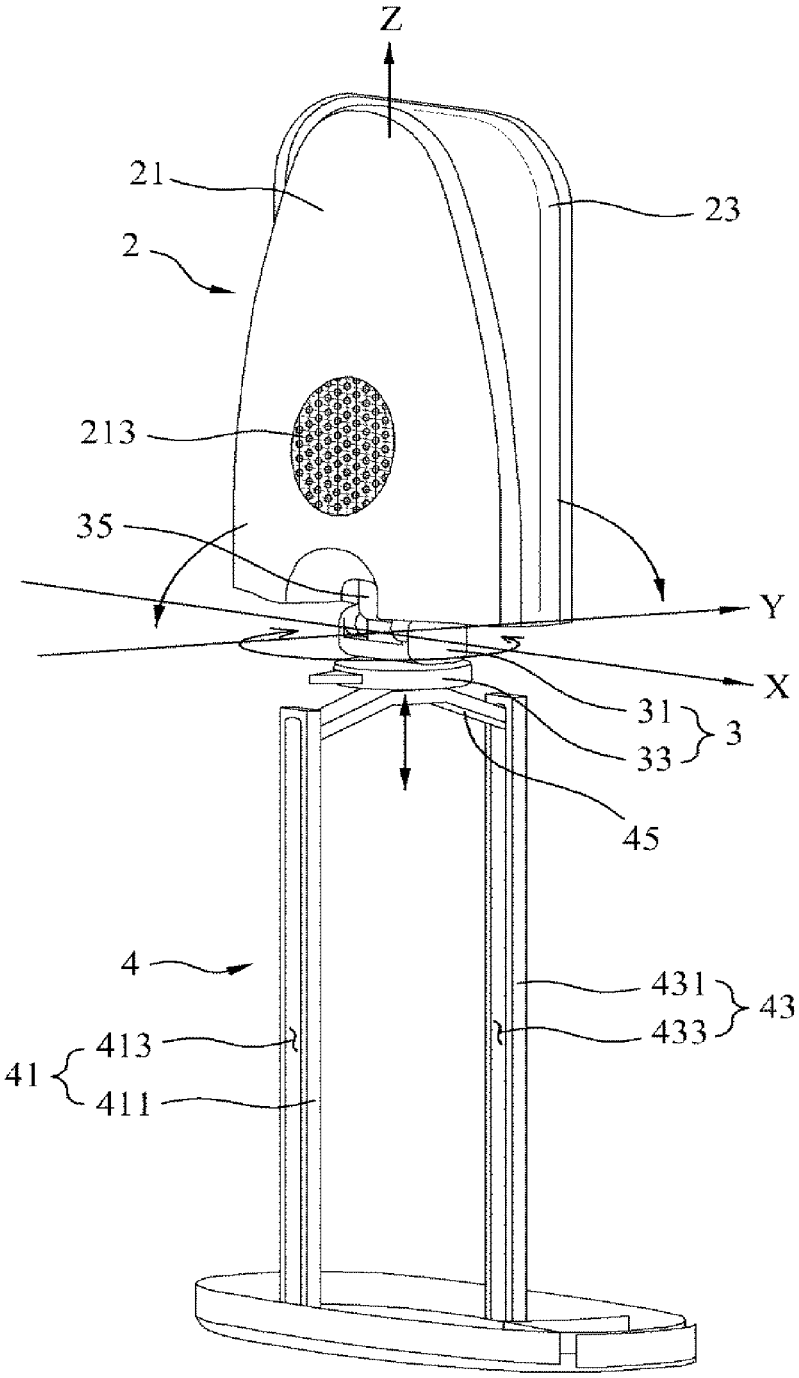
FIG. 4 is a view illustrating a support plate, a hinge unit and a withdrawing unit according to one embodiment of the present invention.

As shown in FIG. 4, the withdrawing unit 4 includes a first guider 41 and a second guider 43, which are arranged in the first accommodation portion 14 in the direction of height of the cabinet 1, and a base supporter 45 movably fixed to the first guider 41 and second guider 43. The hinge unit 3 is fixed to the base supporter 45.

Each of the first guider 41 and second guider 43 may include a vertical rail 411, 431 positioned in the first accommodation portion 14 in the direction of height of the cabinet 1 and a groove 413, 433 provided to the vertical rail 411, 431 to accommodate the base supporter 45.

The hinge unit 3 may include a base 33 fixed to the base supporter 45, a hinge housing 31 fixed to the base 33, and a first hinge 35 and a second hinge 37 arranged to be withdrawable from the hinge housing 31 and respectively coupled to the first support plate 21 and the second support plate 23.

Figure 5:
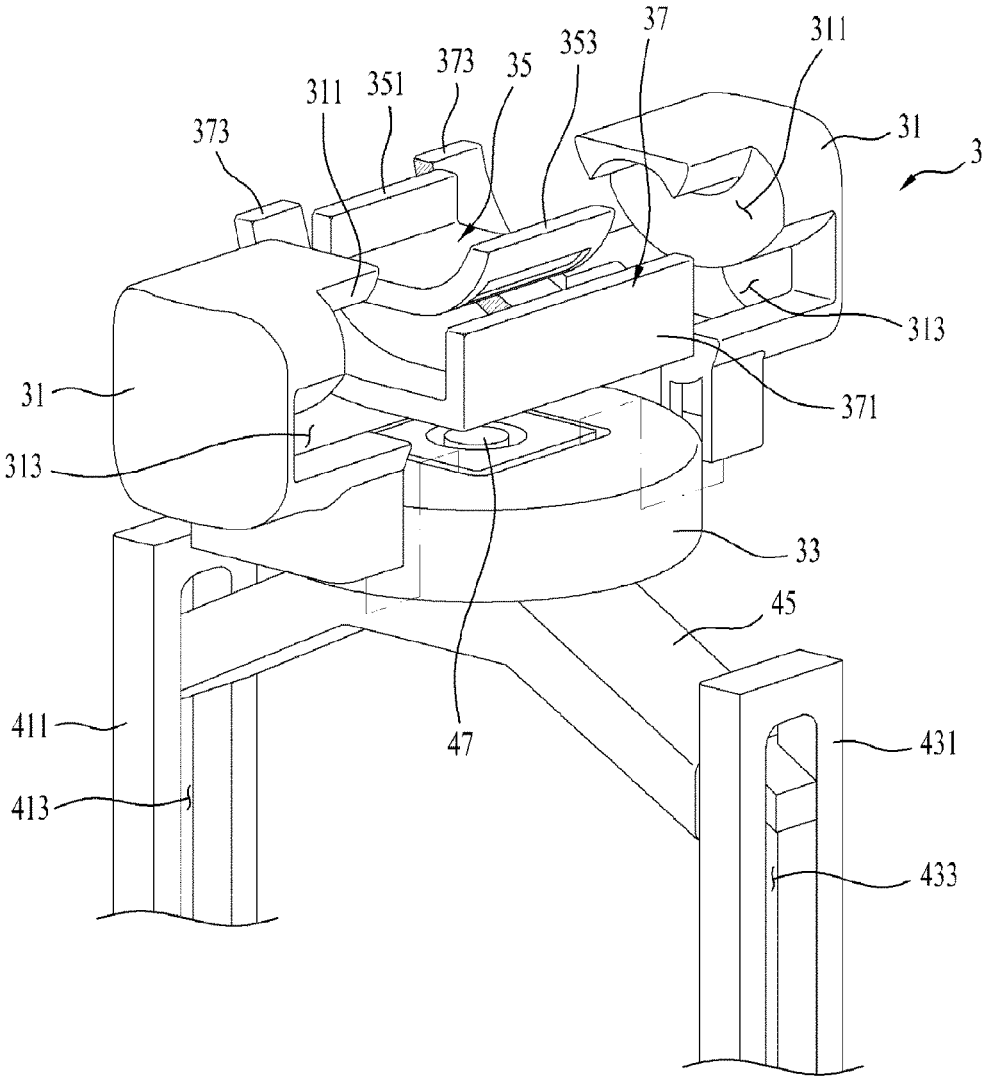
FIG. 5 is an exploded perspective view illustrating a hinge unit according to one embodiment of the present invention.

The base 33 may be rotatably coupled to the base supporter 45 through a base rotation shaft 47 (see FIG. 5). This is intended to allow the first support plate 21 and the second support plate 23 withdrawn from the first accommodation portion 14 and unfolded to rotate in a direction desired by the user and thus facilitate laundry treatment.

As shown in FIG. 5, the hinge housing 31 is provided therein with a first guider hole 311 penetrating the opposite ends of the hinge housing 31 facing each other to accommodate the first hinge 35 and a second guider hole 313 (which may penetrate the opposite ends of the hinge housing 31 facing each other) positioned under the first guider hole 311 to accommodate the second hinge 37.

The first hinge 35 may include a first fixed flange 351 fixed to the first support plate 21 and a first insertion flange 353 extending from the first fixed flange 351 and inserted into the first guider hole 311 to guide rotation of the first support plate 21.

The first fixed flange 351 and the first insertion flange 353 may be arranged in the form of plates coupled to each other. The first insertion flange 353 may be fixed to the first fixed flange 351 such that a predetermined angle (e.g., right angle) is formed between the first insertion flange 353 and the first fixed flange 351. The first insertion flange 353 may form a curved surface having a certain curvature.

In this case, the first guider hole 311 preferably has a curvature allowing the first insertion flange 353 to be movable in the hinge housing 31.

The second hinge 37 includes a second fixed flange 371 and a second insertion flange 373, which are formed in the shape of a plate and coupled to each other.

Herein, the second fixed flange 371 is coupled to the second support plate 23, and the second insertion flange 373 is inserted into the second guider hole 313 to guide rotation of the second support plate 23.

The second insertion flange 373 may also have a curved surface, and the second guider hole 313 may have a curvature allowing the second insertion flange 373 to be movable in the hinge housing 31.

In the case that the width of the second fixed flange 371 is greater than that of the first fixed flange 351, the second insertion flange 373 is preferably provided with two plates spaced a predetermined distance from each other to prevent the first hinge 35 from interfering with the second hinge 37 when the first hinge 35 is inserted into the hinge housing 31.

Figure 6:
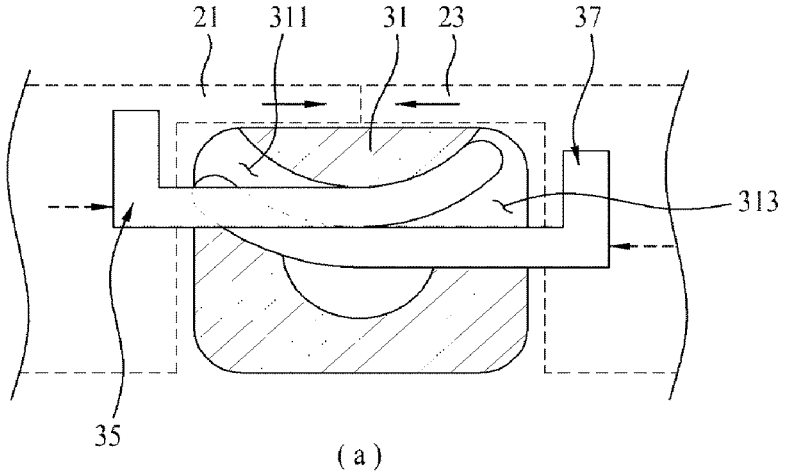
FIG. 6 is a view illustrating movement of the hinge unit.
Figure 6:
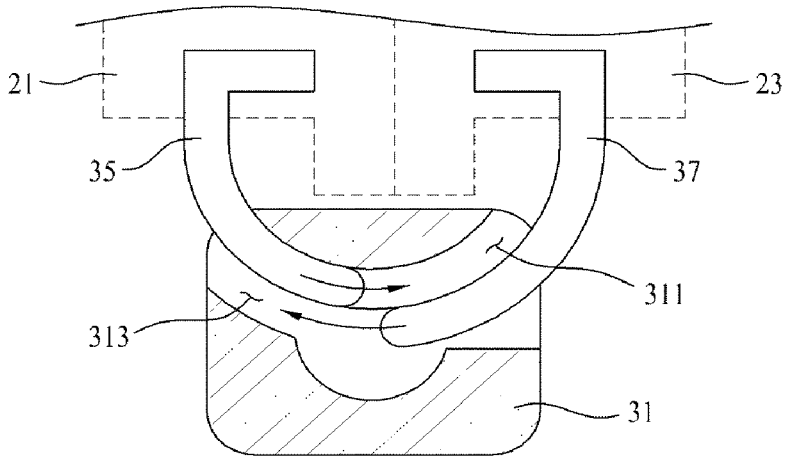

The hinge unit 3 configured as above allows the first hinge 35 and the second hinge 37 to move toward the interior of the hinge housing 31 (see the arrows shown in FIG. 6(*b*)) when the first support plate 21 and the second support plate 23 are unfolded, as shown in FIG. 6. Therefore, when the first support plate 21 and the second support plate 23 are unfolded, surfaces of the first support plate 21 and the second support plate 23 may contact each other with no gap therebetween (FIG. 6(*a*)).

Figure 7:
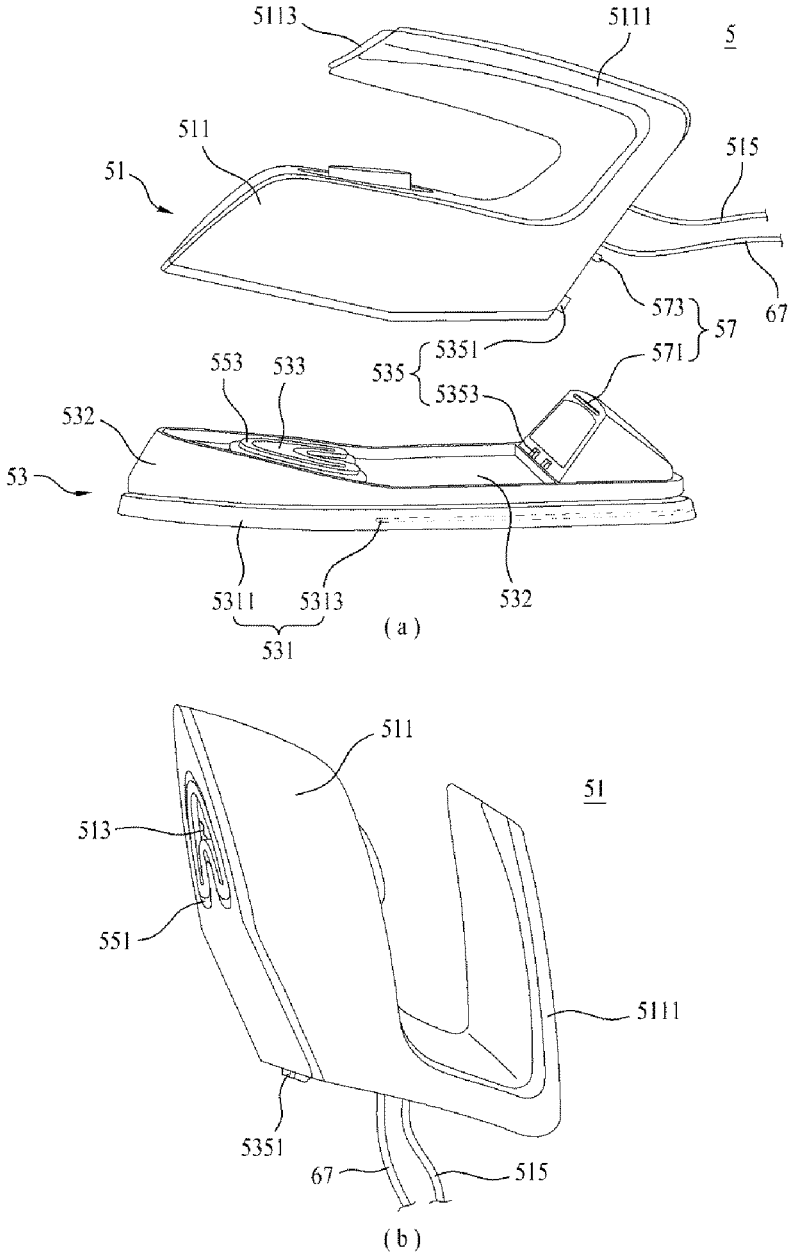
FIG. 7 is a view illustrating a laundry treating unit according to one embodiment of the present invention.

The laundry treating unit 5 (an iron capable of selectively supplying moisture and heat) according to the illustrated embodiment serves to supply one of moisture and heat to the laundry supported on the support part 2. FIG. 7 illustrates an iron capable of selectively supplying moisture and heat to the laundry to remove wrinkles and odor from the laundry, as an example the laundry treating unit 5.

The laundry treating unit 5 may include a moisture supply unit 51 to supply moisture to the laundry, a heat supply unit 53 detachably provided to the moisture supply unit 51 to supply heat to the laundry, a moisture generation units 6 and 7 to supply moisture to the moisture supply unit 51.

The moisture generation units 6 and 7 may be integrally provided to the laundry treating unit 5, or may be provided separately from the laundry treating unit 5. The case of providing the moisture generation units 6 and 7 separately from the laundry treating unit 5 will be described first and then the case of integrally providing the moisture generation units 6 and 7 to the laundry treating unit 5 will be described.

The moisture supply unit 51 includes a body 511 forming the external appearance of the moisture supply unit 51 and a discharge hole 513 provided in the bottom surface of the body 511 to discharge moisture supplied from the moisture generation units 6 and 7 positioned in the third accommodation portion 16 to the laundry.

The body 511 is provided with a handle 5111 allowing the user to move the laundry treating unit 5.

The heat supply unit 53 may be provided with a heating plate 531 mountable to and detachable from the bottom surface of the body 511. The heating plate 531 may be provided with a heating plate body 5311 (provided with a conductor) in which a heating plate heater 5313 is installed.

Meanwhile, the heating plate body 5311 may be provided with a heating plate through hole 533 penetrating the heating plate body 5311 to allow the moisture supplied through the discharge hole 513 to be supplied to the laundry through the heating plate body 5311. This is intended to improve removal of odor and wrinkles from the laundry by supplying heat and moisture to the laundry at the same time.

The heating plate 531 may further include an insulation part 532 (which may be formed of a non-conductive material) fixed to the heating plate body 5311 and blocking transfer of heat from the heating plate body 5311 to the body 511.

In this case, the sealing conduit 5533 may need to be arranged penetrating the insulation part 532 and the heating plate body 5311.

In addition, the laundry treating unit 5 may further include sealing parts 551 and 553 preventing the moisture discharged through the discharge hole 513 from leaking into the space between the bottom surface of the body 511 and the insulation part 532.

The sealing parts may include a sealing groove provided to one of the body 511 and the insulation part 532 and a sealing conduit provided to the other one of the body 511 and the insulation part 532 and inserted into the sealing groove.

In the example illustrated in FIG. 7, the sealing groove 551 is formed by concavely curving the bottom surface of the body 511 along the outer circumferential surface of the discharge hole 513, and the sealing conduit 553 protrudes from the insulation part 532 along the outer circumferential surface of the heating plate through hole 533 so as to be inserted into the sealing groove 551.

In addition, the laundry treating unit 5 may further include a mounting part 57 allowing the heating plate 531 to be attached to and detached from the body 511. The mounting part 57 may include a mounting groove 571 provided to one of the body 511 and the insulation part 532 and a mounting protrusion 573 provided to the other one of the body 511 and the insulation part 532 and inserted into the mounting groove 571.

In the example illustrated in FIG. 7(*a*), the mounting groove 571 is provided to the insulation part 532, and the mounting protrusion is provided to the body 511. In this case, the handle 5111 may be provided with a separation button 5113 configured to separate the mounting protrusion from mounting groove 571.

The heating plate heater 5313 installed in the heating plate body 5311 receives power through a power supply 535. The power supply 535 may include a first terminal 5351 provided to the body 511 to receive power through a power cable 515 (a means receiving external power supplied through an electrical outlet), and a second terminal 5353 provided to the sealing part 55 to contact the first terminal 5351 to transfer power supplied to the first terminal 5351 to the heating plate heater 5313.

The laundry treating unit 5 configured as above receives moisture through the moisture generation units 6 and 7 positioned in the third accommodation portion 16.

In the example illustrated in FIG. 2, the moisture generation units 6 and 7 supplies steam generated by heating water to the moisture supply unit 51.

The moisture generation units 6 and 7 of this embodiment may include a steam generation unit 6 configured to generate steam and a water supply unit 7 configured to supply water to the steam generation unit 6 and be withdrawable from the third accommodation portion 16.

The steam generation unit 6 may include a storage tank 61 provided to the bottom surface of the third accommodation portion 16, a heater 63 provided in the storage tank 61, and a supply tube 67 connecting the discharge hole 513 of the moisture supply unit 51 to the storage tank 61. The heater 63 is turned on/off by the power switch 11 provided to the cabinet 1.

The water supply unit 7 may include a supply tank 71 supported by the tank support plate 165 provided to the third accommodation portion door 161, a discharge port 75 provided to the bottom surface of the supply tank 71, a valve 77 (a check valve) to open and close the discharge port 75, and an introduction port 73 allowing water to be introduced into the supply tank 71 therethrough.

In this case, the steam generation unit 6 is preferably provided with a connection conduit 65 that opens the valve 77 to allow the water in the supply tank 71 to be introduced into the storage tank 61 when the supply tank 71 is inserted into the third accommodation portion 16.

Accordingly, when the supply tank 71 is withdrawn from the third accommodation portion 16 by the third accommodation portion door 161, it is separated from the storage tank 61. When the supply tank 71 is inserted into the third accommodation portion 16 by the third accommodation portion door 161, water may be supplied to the storage tank 61.

In addition, since the supply tank 71 is withdrawn from the third accommodation portion 16 by rotating the third accommodation portion door 161, the use may separate the supply tank 71 from the third accommodation portion door 161 and then fill the supply tank 71 with water or drain the supply tank 71.

Figure 8:
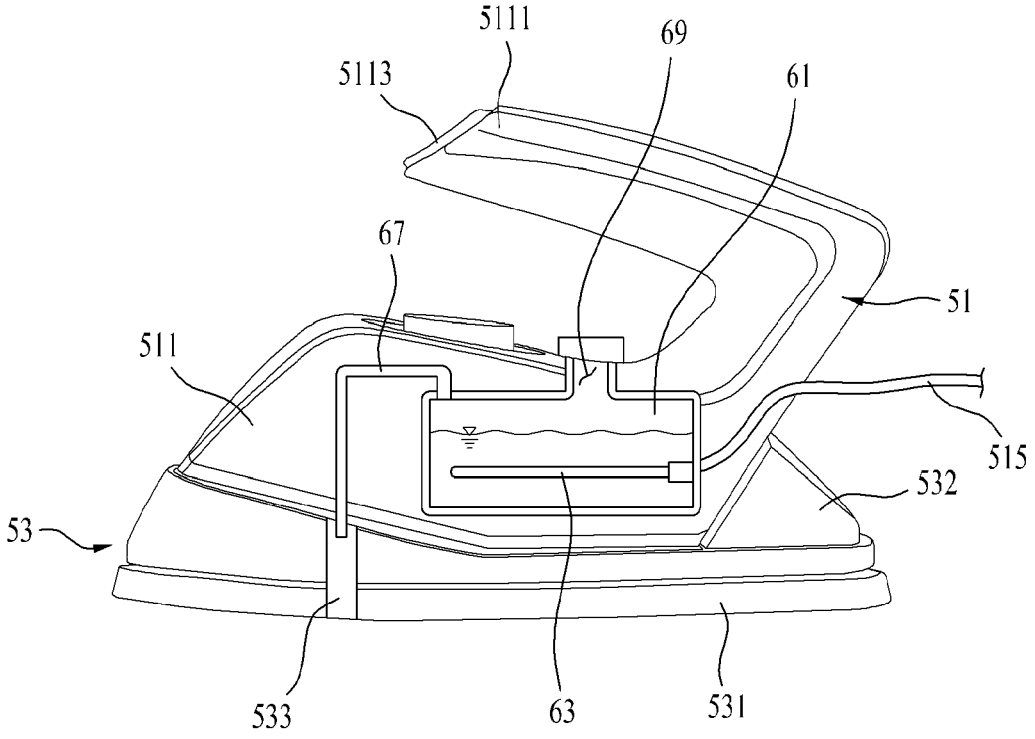
FIG. 8 is a view illustrating a laundry treating unit according to another embodiment of the present invention.

FIG. 8 is a view illustrating a laundry treating unit 5 according to another embodiment of the present invention. In this embodiment, a moisture generation unit is provided in the laundry treating unit 5.

That is, the moisture generation unit provided in the body 511 may be provided only with a steam generation unit 6 discharging steam through the discharge hole 513.

The steam generation unit 6 may include a storage tank 61 provided in the body 511 to store water, a heater 63 provided in the storage tank 61 and receiving power through the power cable 515, a supply tube 67 connecting the storage tank 61 to the discharge hole 513, and a supply port 69 allowing the storage tank 61 to communicate with the exterior of the body 511 therethrough such that water is supplied to the storage tank 61.

In this embodiment, the heat supply unit 53 may be detachably provided to the moisture supply unit 51. The heat supply unit 53 may receive power through a power supply 535 having the same structure as described above.

Figure 9:
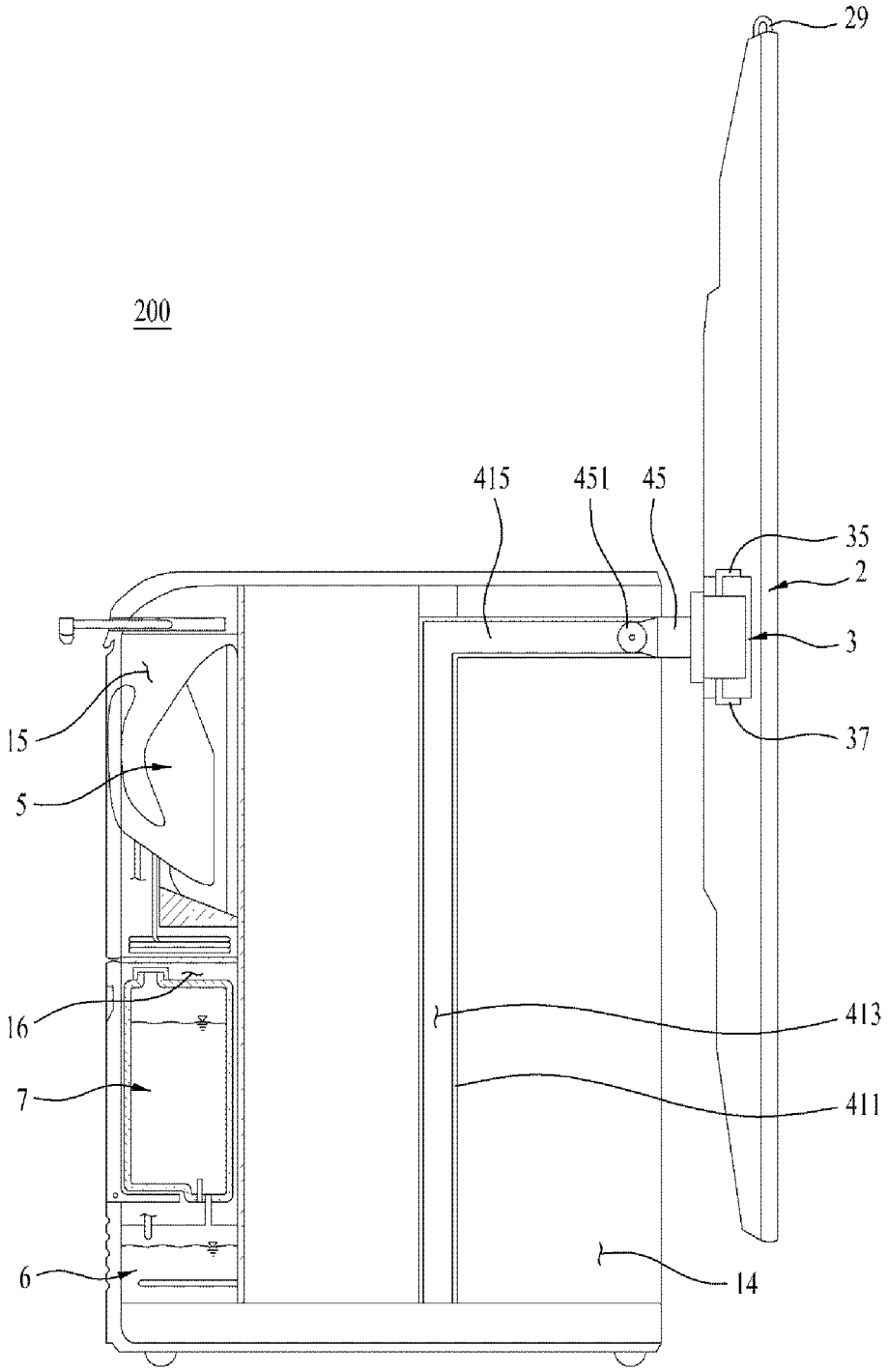
FIGS. 9 and 10 are views illustrating a laundry treating apparatuses according to other embodiments of the present invention.
Figure 10:
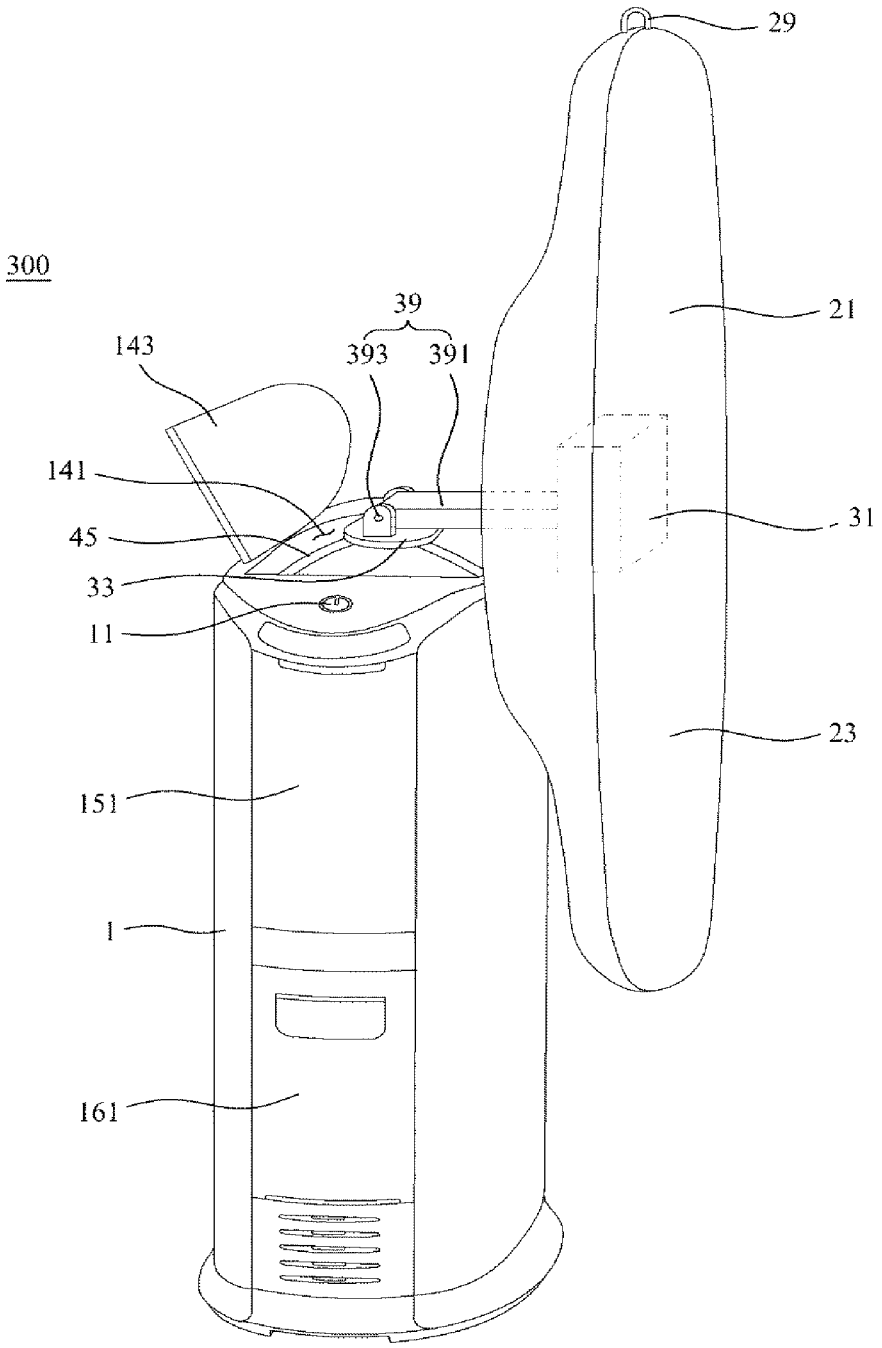

FIGS. 9 and 10 respectively illustrate laundry treating apparatuses 200 and 300 according to other embodiments of the present invention. In these embodiments, the support part 2 may rotate when withdrawn from the first accommodation portion 14, in a plane parallel to the upper surface of the cabinet 1 and be fixed in the direction of height of the cabinet 1.

In the case that the surface of the support part 2 (the flat surfaces provided by the first support plate and the second support plate) is fixed in the direction of height of the cabinet 1, laundry treatment may be performed with the laundry hung on a ring 29 provided to the support part 2 (i.e., a loop formed by concavely deforming the surface of the support part).

The structure allowing the surface of the support part 2 to be fixed in the direction of height of the cabinet 1 may be implemented in various manners. FIG. 9 illustrates an example of such structure in which the surface of the support part 2 is fixed in the direction of height of the cabinet 1 through the structure of the withdrawing unit 4.

The withdrawing unit 4 of this embodiment basically has the same structure as that of the withdrawing unit illustrated in FIG. 4. In this embodiment, the withdrawing unit 4 further includes a horizontal rail provided to the first guider and second guider.

That is, the withdrawing unit 4 of this embodiment includes a first guider 41 and a second guider (not shown), which are provided in the first accommodation portion 14 in the direction of height of the cabinet 1, and a base supporter 45 allowed to reciprocate within the first accommodation portion by the first guider and the second guider.

Each of the first guider 41 and the second guider may include a vertical rail 411 fixed in the first accommodation portion 14 in the direction of height of the cabinet 1, a horizontal rail 415 extending from the upper end of the vertical rail 411 toward the rear surface of the cabinet 1, and a groove 413 provided to the vertical rail 411 and horizontal rail 415 and coupled to the base supporter 45 such that the base supporter 45 is movable.

In this case, the base supporter 45 may be provided with a roller 451 facilitating movement of the base supporter 45 and allowing rotation of the base supporter 45.

Accordingly, when withdrawn from the first accommodation portion 14 through the vertical rail 411, the support part 2 is allowed to move toward the rear surface of the cabinet 1 through the horizontal rail 415. Once moved toward the rear surface of the cabinet 1, the support part 2 is allowed to rotate about the roller 451. Therefore, the laundry treating apparatus 200 of this embodiment may fix the surface of the support part 2 in the height direction of the cabinet 1.

FIG. 10 illustrates an example in which the surface of the support part 2 is fixed in the height direction of the cabinet 1 through the structure of the hinge unit 3.

The hinge unit 3 provided in this embodiment basically has the same structure as that of the hinge unit illustrated in FIG. 5. In this embodiment, the hinge unit 3 further includes a housing rotating part 39 provided between the base 33 and the hinge housing 31.

The housing rotating part 39 includes a bar 391 extending from the hinge housing 31 and a bar rotation shaft 393 rotatably fixing the bar 391 to the base 33.

Accordingly, when withdrawn from the first accommodation portion 14, the support part 2 is allowed to rotate toward a side surface of the cabinet 1 by the housing rotating part 39, and thus the laundry treating apparatus 300 of this embodiment may fix the surface of the support part 2 in the direction of height of the cabinet 1.

Various embodiments have been described in the best mode for carrying out the invention.

INDUSTRIAL APPLICABILITY

The present invention provides a laundry treating apparatus having a laundry treating unit capable of supplying at least one of heat and moisture to the laundry and a support part configured to support the laundry.

In addition, the laundry treating apparatus has a laundry treating unit capable of supplying one or both of heat and moisture to the laundry.

It will be apparent to those skilled in the art that various modifications and variations can be made in the present invention without departing from the spirit or scope of the invention. Thus, it is intended that the present invention covers the modifications and variations of this invention provided they come within the scope of the appended claims and their equivalents.

The invention claimed is:

1. A laundry treating apparatus comprising:

a cabinet forming an external appearance of the laundry treating apparatus;

a support platform configured to be withdrawable from the cabinet, the support platform comprising a first support plate and a second support plate, the first and second support plates forming a space to support laundry when withdrawn from the cabinet and unfolded;

a laundry treating iron configured to be withdrawable from the cabinet, the laundry treating iron supplying at least one of heat or moisture to the laundry supported by the support platform;

a compound hinge that rotatably couples the first support plate and the second support plate; and a guide provided in the cabinet to direct the compound hinge when withdrawn from or introduced into the cabinet, wherein the compound hinge rotates about a vertical axis.

2. The laundry treating apparatus according to claim 1, wherein the support platform further comprises a laundry fixing unit provided to at least one of the first support plate or the second support plate to fix the laundry to surfaces of the first support plate and the second support plate.

3. The laundry treating apparatus according to claim 2, wherein the at least one of the first support plate or the second support plate comprises:

a support plate base providing a space to accommodate the laundry fixing unit, a cover provided to an upper portion of the support plate base to support the laundry, the cover allowing external air to be supplied into the support plate base there through, and an exhaust hole allowing an interior of the support plate base to communicate with an exterior of the support plate base, wherein the laundry fixing unit is a fan to discharge air from the interior of the support plate base to the exterior of the support plate base through the exhaust hole.

4. The laundry treating apparatus according to claim 1, wherein the comprises:

a base supporter coupled to the compound hinge; and a first guider and a second guider provided in the cabinet in a height direction of the cabinet, the first and second guiders guiding movement of the base supporter in the height direction of the cabinet.

5. The laundry treating apparatus according to claim 4, wherein the compound hinge comprises:

a hinge housing connected to the base supporter;

a first guider hole and a second guider hole provided to opposing ends of the hinge housing facing each other;

a first hinge configured to be withdrawable from the first guider hole, the first hinge being fixed to the first support plate; and a second hinge configured to be withdrawable from the second guider hole, the second hinge being fixed to the second support plate.

6. The laundry treating apparatus according to claim 5, wherein the hinge housing is rotatably coupled to the base supporter.

7. The laundry treating apparatus according to claim 5, wherein:

the first hinge comprises a first fixed flange fixed to the first support plate and a first insertion flange extending from the first fixed flange and forming a curved surface; and the second hinge comprises a second fixed flange fixed to the second support plate and a second insertion flange extending from the second fixed flange and forming a curved surface, wherein each of the first guider hole and the second guider hole comprises a curved surface to accommodate a corresponding one of the insertion flanges such that the curve surface penetrates opposing ends of the hinge housing facing each other.

8. The laundry treating apparatus according to claim 7, wherein the first guider hole and the second guider hole are stacked in the height direction of the cabinet, and wherein a width of the second fixed flange is greater than a width of the first fixed flange, and the second insertion flange is provided to opposing ends of the second fixed flange facing each other such that the second insertion flanges are spaced apart from each other to accommodate the first insertion flange therebetween.

9. The laundry treating apparatus according to claim 1, wherein the laundry treating iron comprises:

a moisture supply unit comprising a body having a handle and a discharge hole provided to the body to discharge moisture to the laundry;

a heat supply unit detachably provided to the body to supply heat to the laundry.

10. The laundry treating apparatus according to claim 9, wherein the cabinet comprises:

a first accommodation portion to accommodate the support platform;

a second accommodation portion to accommodate the laundry treating iron; and a first partition wall arranged in the height direction of the cabinet to partition the first accommodation portion and the second accommodation portion.

11. The laundry treating apparatus according to claim 10, wherein the second accommodation portion comprises an inclined surface configured to support the laundry treating iron and to be inclined upward in a direction of withdrawal of the laundry treating iron.

12. The laundry treating apparatus according to claim 11, further comprising a moisture generation unit to generate moisture and supply the same to the moisture supply unit, wherein the cabinet further comprises a third accommodation portion positioned under the second accommodation portion to accommodate the moisture generation unit.

13. The laundry treating apparatus according to claim 12, wherein the moisture generation unit comprises:

a steam generation unit to supply steam generated by heating water to the moisture supply unit;

a water supply unit configured to be withdrawable from the third accommodation portion, the water supply unit supplying water to the steam generation unit by being connected to the steam generation unit when inserted into the third accommodation portion.

14. The laundry treating apparatus according to claim 13, wherein the cabinet further comprises a third accommodation portion door to open and close the third accommodation portion, wherein the third accommodation portion door comprises:

a door body to open and close the third accommodation portion, the door body being rotatably coupled to the cabinet; and a supply unit support plate extending from the door body to support a lower surface of the water supply unit.

15. The laundry treating apparatus according to claim 14, wherein:

the water supply unit comprises a supply tank supported on the supply unit support plate and a check valve provided on a bottom surface of the supply tank; and the steam generation unit comprises a storage tank to store water, a connection conduit provided to the storage tank to open the check valve and allow water to be introduced into the storage tank when the supply tank is inserted into the third accommodation portion, a heater provided in the storage tank, and a supply tube to supply steam from the storage tank to the laundry treating iron.

16. The laundry treating apparatus according to claim 9, wherein the heat supply unit comprises:

a heating plate detachably provided to the moisture supply unit; and a heating plate through hole penetrating the heating plate and connected to the discharge hole.

17. The laundry treating apparatus according to claim 16, wherein the heating plate further comprises:

a heating plate body formed of a conductor and provided with the heating plate through hole;

a heating plate heater to heat the heating plate body; and an insulation part fixed to the heating plate body and detachably coupled to the body, the insulation part blocking transfer of heat of the heating plate body to the body.

18. The laundry treating apparatus according to claim 17, further comprising:

a sealing groove provided to one of an outer circumferential surface of the discharge hole and an outer circumferential surface of the heating plate through hole; and a sealing conduit provided to the other one of the outer circumferential surface of the discharge hole and the outer circumferential surface of the heating plate through hole to be inserted into the sealing groove.

19. The laundry treating apparatus according to claim 18, further comprising a mounting part to detachably couple the heat supply unit to the moisture supply unit, wherein the mounting part comprises:

a mounting groove provided to one of the body and the heating plate; and a mounting protrusion provided to the other one of the body and the heating plate to be mounted to and detached from the mounting groove.

20. The laundry treating apparatus according to claim 17, wherein the laundry treating iron further comprises a power supply to supply power to the heating plate heater, wherein the power supply comprises:

a first terminal provided to the body, the first terminal being connected to a power source; and a second terminal provided to the insulation part to contact the first terminal, the second terminal being configured to supply power from the first terminal to the heating plate heater.

21. The laundry treating apparatus according to claim 9, further comprising a moisture generation unit to generate moisture and supply the same to the discharge hole, the moisture generation unit being provided in the body, wherein the moisture generation unit comprises:

a storage tank provided in the body to store water;

a heater provided in the storage tank to heat the water; and a supply tube connecting the storage tank to the discharge hole.

22. The laundry treating apparatus according to claim 1, further comprising:

a shaft coupling the compound hinge to the shaft, wherein the compound hinge rotates about the shaft.

* * * * *